United States Patent [19]

Logue

[11] Patent Number: 4,629,235

[45] **Date of Patent: * Dec. 16, 1986**

[54] RETRIEVER AND DISPENSER FOR DEFORMABLE BALLS

[76] Inventor: Dewitt M. Logue, P.O. Box 988, Longview, Tex. 75606

[ * ] Notice: The portion of the term of this patent subsequent to Jun. 11, 2002 has been disclaimed.

[21] Appl. No.: 742,901

[22] Filed: Jun. 10, 1985

Related U.S. Application Data

[63] Continuation-in-part of Ser. No. 568,702, Jan. 6, 1984, Pat. No. 4,522,438.

[51] Int. Cl.[4] ..... A63B 47/02

[52] U.S. Cl. ..... 294/19.2; 221/65; 221/306; 403/108

[58] Field of Search ..... 294/19.2; 206/315.9; 211/14, 15; 220/8, 293, 300; 221/65, 185, 188, 199, 281-283, 289, 303, 304, 306, 309, 310, 312 C; 224/919; 273/29 R, 32 D, 162 E, 201; 285/303; 403/108, 109, 378, 379

[56] References Cited

U.S. PATENT DOCUMENTS

| | | | |
|---|---|---|---|
| 1,216,869 | 2/1917 | Snigo | 220/300 X |
| 2,768,775 | 10/1956 | Houser | 221/185 |
| 4,082,209 | 4/1978 | Sanders | 221/309 X |
| 4,088,251 | 5/1978 | Rodriguez | 294/19.2 X |
| 4,183,691 | 1/1980 | Van Melle | 403/109 |
| 4,522,438 | 6/1985 | Logue | 294/19.2 |

FOREIGN PATENT DOCUMENTS

| | | | |
|---|---|---|---|
| 3132761 | 3/1983 | Fed. Rep. of Germany | 294/19.2 |
| 1121346 | 8/1956 | France | 285/303 |
| 2454820 | 12/1980 | France | 294/19.2 |
| 682885 | 11/1952 | United Kingdom | 294/19.2 |

*Primary Examiner*—Johnny D. Cherry
*Attorney, Agent, or Firm*—Gunn, Lee & Jackson

[57] ABSTRACT

An elongated tubular member for retrieving and dispensing deformable balls, such as tennis balls, is provided with retrieving structure at one extremity and dispensing structure at the opposite extremity. The retrieving structure forms an inlet opening having internal projections requiring deformation of a ball being forced through the inlet opening. The dispensing structure forms primary and secondary dispensing openings and a restraining lip preventing inadvertent movement of the lowermost ball through the primary dispensing opening. The dispensing structure also forms a manual access opening, permitting access to the lowermost ball by the fingers of the user to permit dispensing movement of the lowermost ball. The dispensing structure also includes a closure and dispensing cap positionable for closing the dispensing opening to secure balls within the tubular member for storage and positionable to permit dispensing of balls from the dispensing opening. The tubular member is formed by telescoping tube sections permitting the tubular member to be collapsed for storage or extended for use. A locking mechanism is provided to secure the tubular sections at any desirable telescoping position.

21 Claims, 9 Drawing Figures

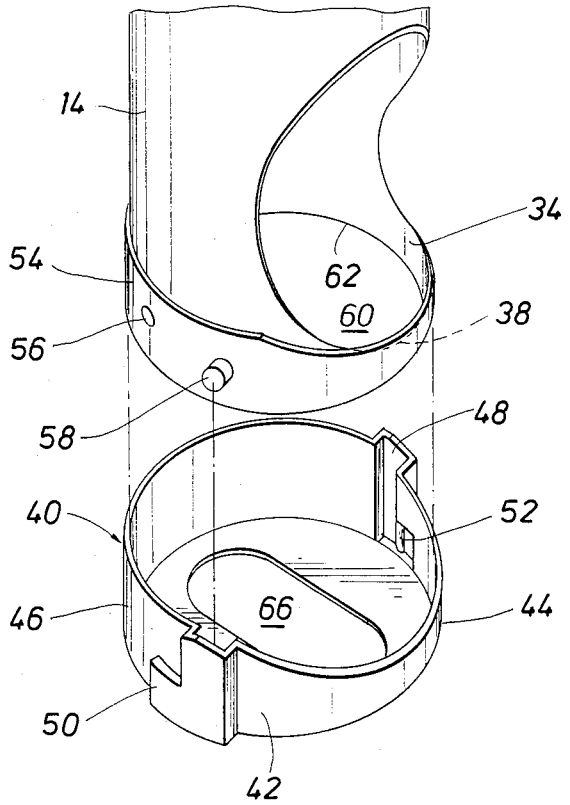
FIG. 7
FIG. 8
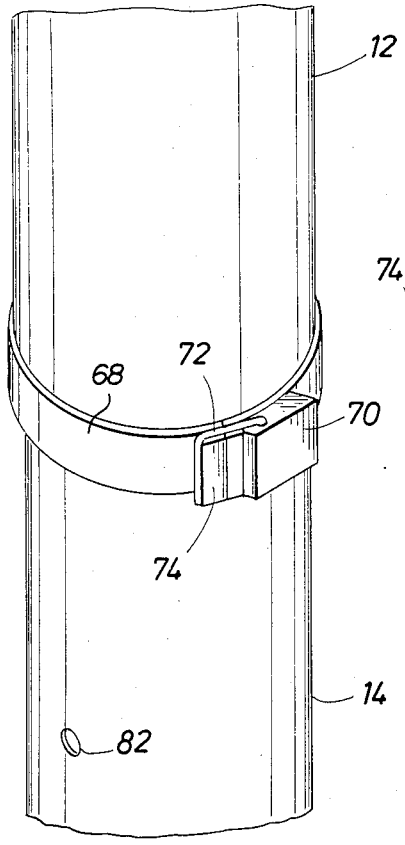
FIG. 9
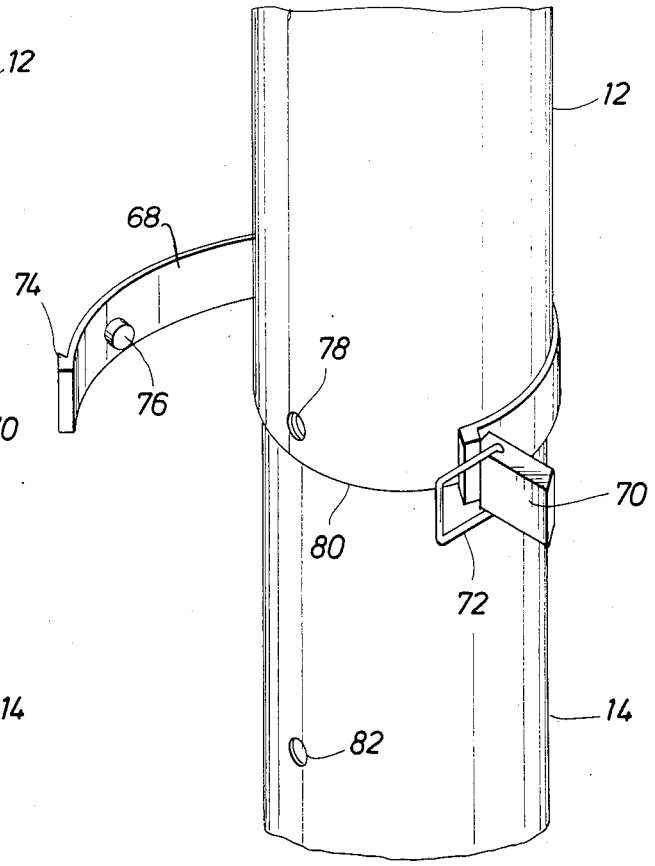

RETRIEVER AND DISPENSER FOR DEFORMABLE BALLS

This is a continuation-in-part of Application Ser. No. 06/568,702, filed Jan. 6, 1984, for Retriever and Dispenser for Deformable Balls, now U.S. Pat. No. 4,522,438.

FIELD OF THE INVENTION

This invention relates generally to devices for retrieving and/or dispensing balls to thus minimize the manual effort required to gather up loose balls and selectively dispense them. More specifically, the present invention relates to an elongated tubular retriever and dispenser for compressible balls, such as tennis balls, enabling them to be retrieved through an inlet opening at one end of the device and dispensed through one or more dispensing openings at the opposite end.

BACKGROUND OF THE INVENTION

During practicing of sporting activities such as tennis, players typically hit a large number of balls which then lie about on the tennis court or other playing surface. Players are then typically required to retrieve the balls and place them in a suitable container for storage until use in again desired. In the case of tennis practicing, time studies have determined that far more time is typically spent in retrieving tennis balls from a court than the time actually spent in hitting the tennis balls during practice sessions. Moreover, the retrieval of loose tennis balls can be an extremely tiring effort, requiring the player to bend over a large number of times to pick up balls from the playing surface and place them in a container. It is desirable, of course, to provide apparatus for retrieving and dispensing tennis balls wherein the user will be provided with the capability of achieving greater practice time as compared to the time spent in retrieving the balls. It is also desirable to provide a retrieving and dispensing device for balls which is utilized by persons without the necessity to bend over and pick up the balls.

DESCRIPTION OF THE PRIOR ART

A number of devices have been developed over the years for the purpose of enabling more efficient retrieval and/or dispensing of balls such as golf balls, tennis balls and the like. Moreover, certain devices have also been developed which facilitate the retrieval of deformable balls such as tennis balls. One commonly used device takes the form of a large wire basket having a handle by which it is carried by users. The wire forming the lower wall of the basket is spaced slightly less than the diameter of a tennis ball, there being a number of rectangular openings defined by the wire through which a tennis ball may be forced. The user merely sits the wire basket on top of a tennis ball resting on a tennis court and applies downward force. This downward force causes the wires to deform the tennis ball and allow the tennis ball to enter one of the bottom openings of the basket. For dispensing, the basket merely rests on a tennis court or other suitable surface and the user manually gathers balls from the open top of the basket and carries out practice exercises. The large baskets make it difficult to pick up tennis balls which are lying in corners or against side fences of a tennis court. In this case the balls must be moved away from the tennis court such as by the foot of the user or with a tennis racquet, and the wire basket is then used to gather them. This is a cumbersome and tiring activity. Also, when almost full the basket is quite heavy. The user tends to tire more from the basket lifting activity than from the exercise of practicing tennis.

Known patented prior devices which may be pertinent to the present invention include the devices shown in the following patents.

Tubular tennis ball retrieval and dispensing devices are shown by U.S. Pat. Nos. 4,088,251 of Rodriguez and 4,058,366 of Parkinson.

Tennis ball retrieval devices without a dispensing capability are shown by U.S. Pat. Nos. 3,957,297 of Hanks and 4,045,068 of Nelson.

Other U.S. Pat. Nos. of general interest are Fowler, et al, 2,962,321; Motard 3,281,013; Stanworth 3,558,170; Watson 2,760,807 and Ose 4,253,668. British Pat. Specification No. 682,899 of Nov. 19, 1952, and French Pat. No. 2,454,820 disclose tubular devices for picking up and dispensing balls.

SUMMARY OF THE INVENTION

It is, therefore, a primary feature of the present invention to provide a novel device for retrieving and dispensing deformable balls, such as tennis balls and the like which enables a user to pick up balls without necessitating that the user bend over a number of times.

It is a further feature of this invention to provide a novel ball retrieval and dispensing device which is effective for picking up balls lying in corners or adjacent fences without necessitating first moving them to an unobstructed area.

It is an even further feature of the present invention to provide a novel device for retrieving and dispensing tennis balls and the like which is positionable at any suitable level for dispensing and which positions the balls in serial manner for dispensing.

Among the several features of this invention is contemplated the provision of a novel retrieval and dispensing device for tennis balls and the like which is extendable to a significant length for use and which is collapsible to approximately 50% of that length for the purpose of storage.

It is also a feature of this invention to provide a novel retrieval and dispensing device for tennis balls and the like which includes a lockable closure to facilitate efficient storage of balls without the possibility of the balls becoming inadvertently separated from the device during storage or transportation.

It is also a feature of this invention to provide a novel retrieval and dispensing device for tennis balls and the like which is capable of being manually transported by means of a shoulder strap, thus permitting the user to have the hands free for other activities such as when walking to or from a practice court.

Briefly, the present invention is in the form of an elongated tubular housing which may be in the form of an elongated tube or which may be formed by two or more tubular, telescoping sections which have a facility for being locked in assembly by a suitable locking device. The tubular retrieving and dispensing device may be extended to a long length for use or it may be collapsed to a much shorter length for efficient storage and transportation. At one end of the tubular retrieval and dispensing device is provided retrieving means which is generally in the form of a retrieval cap that is fixed to one end of the tubular sections. The retrieval cap defines an inlet opening of slightly larger diameter than the diameter of the balls being retrieved. The retrieving cap also defines a plurality of radially inwardly directed projections which are equally spaced about the inlet opening. As a deformable ball is forced through the inlet opening, these projections cause slight deformation of the ball. After the ball has been forced through the inlet opening, the radially extending projections furnction to support the ball to prevent it from falling out of the inlet opening. The projections provide sufficient resistance to support an entire column of serially arranged balls within the internal passage. Each projection forms a tapered guide surface to thus enable the retrieval extremity of the device or the ball being retrieved to be guided into retrieving relation with the inlet opening such that the ball may be forced through the opening and into an elongated internal substantially straight storage passage defined by the tubular housing.

After the internal passage has been filled with balls, the elongated tubular member is then inverted, thus positioning a dispensing structure at its lower extremity in this inverted position. The retrieval cap structure also defines a hook enabling the tubular member to be supported by the hook on any suitable object such as a wire fence, for example, to thus locate it away from the playing surface, where it otherwise might constitute a hazard to the user who might be moving about the court without paying full attention to its presence.

With the ball retrieving and dispensing device positioned in inverted manner, its lower extremity is defined by a dispensing structure having facility for being open to permit dispensing or being closed to secure the balls within the internal passage for storage. A dispensing opening is formed in the side wall at the lower portion of the tubular member slightly above the lower end thereof. Another dispensing opening is defined by the open end of the tubular member. A dispensing cap is removably secured to the lower portion of the tubular member and provides a transverse bottom wall for supporting the lowermost ball of the serially oriented balls contained within the internal passage. A restraining lip is defined by the lower portion of the tubular member which functions in the open position of the dispensing cap to retain the lower ball within the internal chamber and prevent its inadvertent dispensing. A manual access opening of elongated form is defined by the bottom wall of the dispensing cap, thereby enabling the user to insert the fingers through the opening and into engagement with the lower ball. By applying slight upward and transverse force, the lower ball is moved upwardly over the restraining lip and is ejected transversely through the primary dispensing opening where it falls into the open hand of the user.

The cylindrical wall portion of the dispensing cap is cut away or tapered so as to define an upstanding wall portion of reduced height which is positionable in surrounding protection relation with the restraining lip when the cap is at its open position to permit dispensing of balls through the transverse dispensing opening. In the closed position, the upstanding wall is positioned so that its higher portion forms a closure at least partially blocking the dispensing opening, thus providing for efficient storage of the balls until use is desired.

The elongated tubular member may be composed of a pair of telescoping tubular sections which are capable of extension to a long length, for example, in the order of four feet and which may be telescoped to a collapsed position of short length, i.e., in the order of two feet in length. The telescoping sections may be locked at any suitable extended or collapsed position by means of a circular locking band member having an integral locking pin which is positionable in aligned locking and positioning holes of the tubular sections. The innermost telescoping tubular member defines a plurality of spaced positioning holes along its length which are selectively aligned with the locking hole of the outer tubular member to permit selective relative positioning of the tubular sections.

Other and further objects, advantages and features of the present invention will become apparent to one skilled in the art upon consideration of this entire disclosure, including the specification, claims and the annexed drawings. The form of the invention, which will now be described in detail, illustrates the general principles of the invention, but it is to be understood that this detailed description is not to be taken as limiting the scope of the present invention.

BRIEF DESCRIPTION OF THE DRAWINGS

So that the manner in which the above recited features, advantages and objects of the present invention are attained and can be understood in detail, more particular description of the invention briefly summarized above, may be had by reference to the embodiment thereof which is illustrated in the appended drawings, which drawings form a part of this specification.

It is to be noted, however, that the appended drawings illustrate only a typical embodiment of this invention and are, therefore, not to be considered limiting of its scope, for the invention may admit to other equally effective embodiments. Referring now to the accompanying drawings, which are for illustrative purposes only:

FIG. 7 is an exploded isometric view showing the lower end of the inner tubular member and the dispensing cap in axially spaced relation.

FIG. 8 is a partial isometric view illustrating the locked relationship of the telescoping tubular sections.

FIG. 9 is a partial isometric view similar to FIG. 8 and showing the unlocked relationship of the telescoping tubular sections.

DETAILED DESCRIPTION OF THE PREFERRED EMBODIMENT

Figure 1:
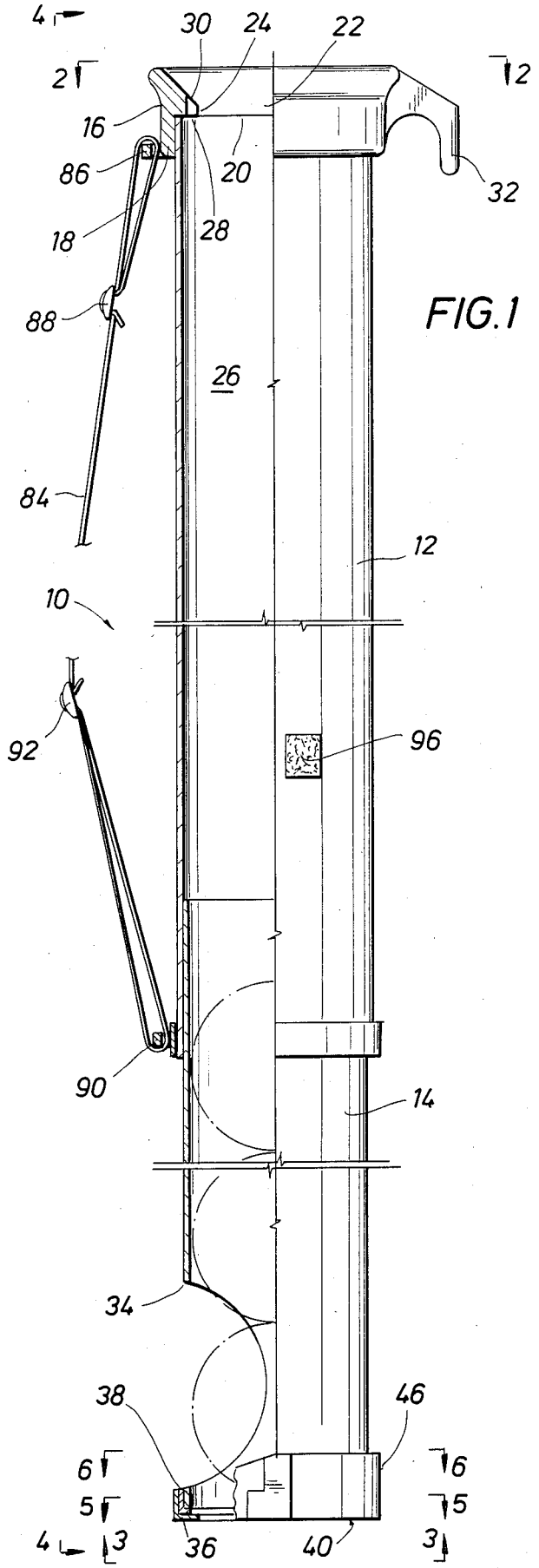
FIG. 1 is a sectional view of a ball retrieving and dispensing device constructed in accordance with the present invention and showing the partially extended telescoped position thereof with the dispensing cap in the open position.

Referring now to the drawings and first to FIG. 1, a ball retrieval and dispensing device, shown generally at 10, is in the general form of an elongated tubular housing which is defined by inner and outer telescoping housing sections, 12 and 14, which, for example, may be formed of any one of a number of suitable plastic or metal materials. More preferably, for the purpose of durability, the tubular housing sections, 12 and 14, are formed of plastic material which will not become permanently dented, bent or otherwise deformed during storage, transportation, or use. In the position shown in FIG. 1, the outer housing section, 12, is provided with a generally circular ball retrieval cap, 16, which forms a circular skirt or flange 18, that is received in tightfitting relation about the upper extremity of the outer housing section. The ball retrieval cap, 16, also defines an internal circular abutment shoulder, 20, against which the upper extremity of the outer tubular section is abutted. The ball retrieval cap may be cemented, bonded, or otherwise affixed to the outer tubular section in any suitable manner.

It is desirable that balls be guided to a retrieval opening formed by the device and that suitable force be applied to force the ball through the retrieval opening and into an internal chamber or passage formed by the device. For this purpose, the ball retrieval cap, 16, defines a generally circular ball retrieval opening, 22, which is of slightly larger diameter than the diameter of the balls to be retrieved. A plurality of radially inwardly extending projections, 24, are formed integrally with or otherwise provided on the ball retrieval cap. These projections form restrictions to the passage of a ball through the inlet opening, 22, and into an elongated internal passage, 26, defined by the tubular members. In order for a deformable ball, such as a tennis ball, to pass through the opening, 22, into the passage, 26, it, must be forced past the ball deforming projections, 24. Tennis balls and other deformable balls of like nature may be forced past the radial projections, 24, simply by applying a downward force on the ball retrieval and dispensing device in the position shown in FIG. 1 with the ball resting on a firm surface. After the ball has entered the tubular passage, 26, abrupt shoulders, 28, form restrictions to support the lowermost tennis ball within the tubular passage and thus prevent it from falling out of the retrieval opening. For the purpose of guiding the balls and the tubular member for registry of the balls with the retrieval opening, 22, the radial projections are formed to define tapered guide surfaces, 30. Guide surfaces, 30, are tapered toward the inlet opening, 22, such that when a ball is engaged in offcenter relation by the ball retrieval cap, either the ball or the ball retrieval cap or both will be shifted transversely for proper orienting relation of the ball with the inlet opening. The tapered guide surfaces, therefore, establish proper orienting relationship between the ball and opening, 22, such that a simple downward force on the device as shown in FIG. 1 causes the ball to be forced past the radial projections and into the elongated passage, 26, of the device.

Figure 4:
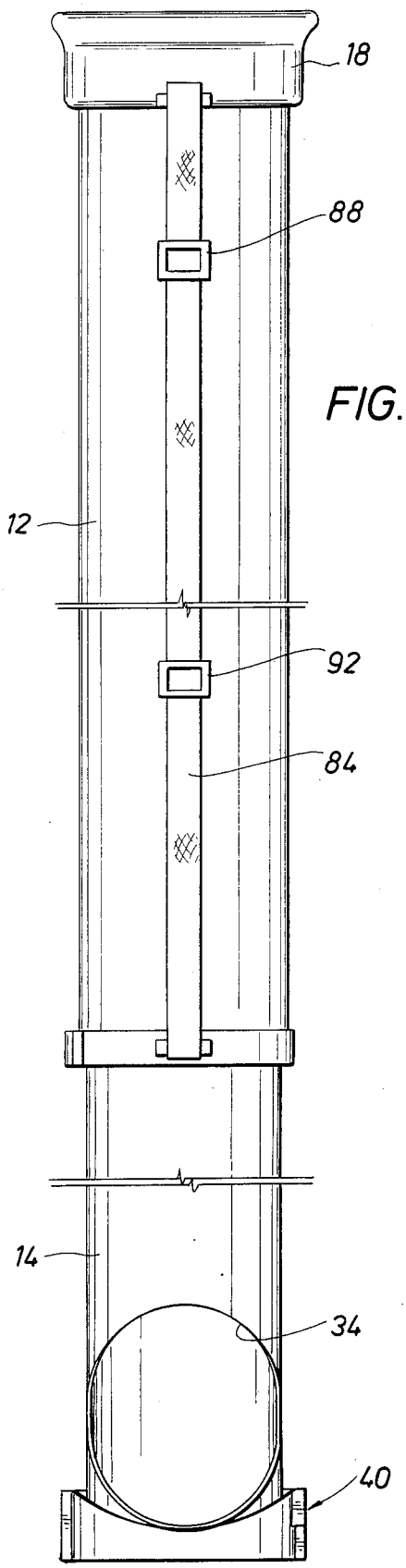
FIG. 4 is an elevational view of the ball retrieval and dispensing device taken along line 4—4 of FIG. 1 and showing the dispensing cap in the closed position thereof.
Figure 2:
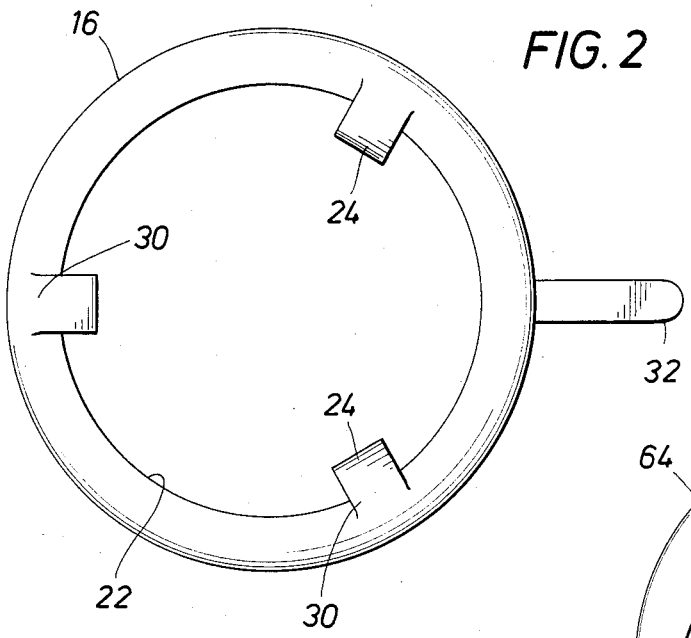
FIG. 2 is an end view taken along line 2—2 of FIG. 1.

The ball retrieval cap, 16, also forms a hook member, 32, which may be integral with the cap structure. The hook member, 32, is employed to support the ball retrieval and dispensing device in the dispensing position thereof as shown in FIGS. 1 and 4. The hook member, 32, may be brought into engagement with the wire of a wire fence or with any other suitable support object for support of the device in a position sufficiently elevated that a ball may be grasped and removed from the device without necessitating significant bending of the user's body. Moreover, the device may be supported in an elevated, out of the way, position so that it does not present an obstruction or hazard on the playing surface. In many cases, conventional ball dispensing devices must rest on a playing surface and thus present a serious safety hazard to the user who frequently moves about the playing surface with rapid movements determined by the force and direction of the approaching ball and perhaps without paying full attention to the presence of the ball dispenser.

With the ball retrieval and dispensing device positioned as shown in FIG. 1, dispensing means is located at the lower extremity thereof and may take the form shown at the lower portion of FIGS. 1 and 4. The lower portion of the inner tubular section, 14, is formed to define a primary dispensing opening, 34, which is located a short distance above the lower extremity, 36, of the inner housing section, such that the lower portion of the housing defines an upstanding arcuate restraining lip, 38, which functions to restrain free transverse movement of the lower serially arranged ball in the internal passage, 26. A dispensing cap, 40, is provided which is of generally circular form and is adapted to be received about the lower extremity of the inner tubular member 14. As is evident from FIG. 7, the dispensing cap 40 defines a generally cylindrical wall 42 forming a generally semi-cylindrical dispensing section 44, and a generally semi-cylindrical closure section 46. The dispensing and closure sections of the cylindrical wall 42 are separated by a pair of L-shaped bayonet slot structures 48 and 50. These bayonet slot structures are preferably formed integrally with the wall structure 42 such as by a molding operation, but may be defined in any other suitable manner. The lower, wider portions of the slot structures are provided with intermediate restriction elements such as shown at 52 which are also preferably molded in integral assembly with the cap structure. At the lower portion of the inner tubular member 14 is provided an encircling band 54 which is retained in assembly with the lower tubular element by means of brad or rivet members 56. The encircling band 54 functions as a strengthening band for the lower extremity of the inner tubular member and also serves as a retainer band for securing the dispensing cap 40 in assembly with the inner tubular element. The encircling band 54 is provided with a pair of opposed cap locking projections 58 which also may be formed integrally with the encircling band. The locking projections 58 are of a dimension permitting them to be received within the opposed L-shaped slots 48 and 50. When the dispensing cap 40 is fully seated with respect to the lower end of the inner tubular member 14 thus positioning the locking projections 58 at the bottom portions of the respective L-shaped slots, the cap member is rotated slightly, thus moving the locking projections past the restriction elements 52 and thus into the undercut portions of the L-shaped slots. The restriction elements prevent the dispensing cap from inadvertently rotating to a position aligning the locking projections with the vertical portions of the slots. The dispensing cap is thus retained in its assembled relation with the lower end of the inner tubular member until it is counterrotated to a position aligning the locking projections 58 with the parallel vertical portions of the slots, thus allowing its removal.

As is evident from FIG. 7 and as mentioned above, the dispensing cap 40 is provided with a dispensing wall section 44 which is cut away and is of less height as compared to the closure wall section 46 thereof. When assembled with the lower end of the inner tubular member 14, when oriented as shown in FIG. 7, the dispensing cap is in its dispensing position, thus permitting balls to be ejected transverse from the dispening opening 34 after having been raised to clear the upstanding lip 38. When it is desired to substantially close the dispensing opening 34 and thus prevent dispensing of balls from the tubular passage 26, the dispensing cap 40 is simply removed and rotated 180° from the position shown in FIG. 7, thus aligning the locking projections 58 with opposite ones of the bayonet slot structures 48 and 50. The dispensing cap is locked to the lower extremity of the tubular member 14 by a slight rotational movement shifting the locking projections past the restriction elements 52 and into the undercut portions of the L-shaped slots. The dispensing cap is thus positionable at its open or closed positions as selected by the user and is locked in assembly with the inner tubular member at both positions. The dispensing cap is removable from the lower end of the inner tubular member, thus exposing a secondary dispensing opening 60 defined by the lower circular extremity 62 of the inner tubular member. With the dispensing cap removed from the inner tubular member all of the balls within the internal passage 26 may be dispensed at once.

Figure 5:
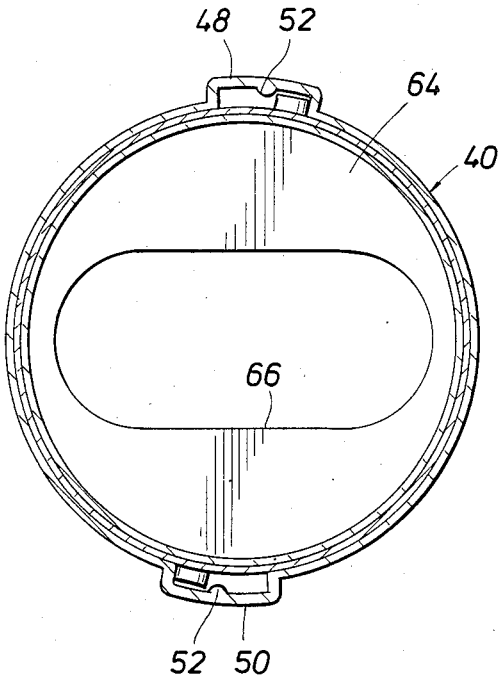
FIG. 5 is a sectional view taken along line 5—5 of FIG. 1.
Figure 6:
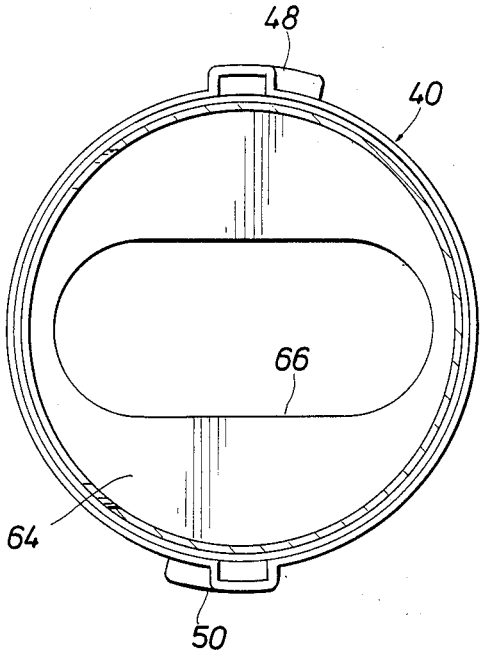
FIG. 6 is a sectional view taken along line 6—6 of FIG. 1.

As is evident from FIGS. 5 and 6 the dispensing cap 40 defines a substantially planar transverse wall 64 which provides support for the lower serially arranged ball within the internal passes 26. The transverse or bottom wall 64 is also formed to define an elongated manual access opening 66 which is best shown in FIGS. 5 and 6. The fingers of the user may be inserted through the elongated manual access opening 66 thus providing for manual engagement with the lower ball of the internal passage. The user will then apply sufficient, simultaneous upward and transverse force to move the lower ball upwardly and over the arcuate upstanding restraining lip 38 while simultaneously moving the ball through the dispensing opening 34, thereby allowing the hand of the user to be positioned to catch the ball as it drops from the dispensing opening. Balls can therefore be dispensed singly and as many balls as desired may be individually collected by the user for practice activities.

It is desirable that the elongated tubular ball retrieval and dispensing device be of sufficient length to contain a significant number of balls for efficient practice activities and yet that it be capable of being reduced in length for efficient storage and handling. Accordingly, the device may conveniently take the form shown particularly in FIGS. 8 and 9. The lower extremity of the outermost tubular member 12 is provided with an encircling locking strap 68 which is secured to the outer tubular member by brads, rivets or the like. The locking strap 68 is provided with a toggle type buckle or clasp 70 which is capable of locking the end portions of the strap in positive locked assembly. The buckle or clasp member 70 is pivotally mounted at one end of the encircling locking strip 68 and is provided with a locking bail member 72 which is engagable with a locking hook member 74 to thus lock the strap member in place. Intermediate the extremities of the locking strap is a locking projection or pin 76 which extends from the inner surface portion of the locking strap. The locking projection 76 is positioned to extend through a locking opening 78 formed in the outer tubular member 12 adjacent the lower extremity 80 thereof. The inner tubular member 14 is provided with a plurality of spaced positioning openings 82 which are selectively positionable in registry with the locking opening 78. With a positioning opening in registry with the locking opening, the strap member 68 is brought into encircling relation about the lower end of the outer tubular member. As the strap member is positioned, the locking projection 76 is extended through the registering openings 78 and 82, thus securing the inner and outer tubular sections in selected telescoping relation. The locking bail is then positioned about the hook member 74 and the toggle buckle or clasp is pivoted to its locked position, securely tightening the strap in assembly about the outer tubular member. When this is done, the locking projection 76 is firmly retained in its interlocking relationship with the registering openings 78 and 82 of the tubular sections. The tubular sections are thus positively locked in the selected position and may be moved in telescoping relation only after subsequent removal of the locking projection from the registering openings.

For support of the ball retrieval and dispensing device on the body of the user an adjustable support strap is provided as shown at 84 in FIG. 1. The retrieval cap member 16 is provided with a strap retainer element 86. One end of the strap member 84 is looped about the strap retainer and is secured by means of a buckle member 88. The opposite end of the strap member 84 is looped about a strap retainer element 90 which extends from the encircling locking strap. A second buckle or clasp 92 is utilized to secure the free end of the strap member. The strap is adjustable by means of the lower buckle element 92 to any suitable length desired by the user. The upper buckle or clasp member 88 secures the strap to the strap retainer and eliminates any need for sewing the strap in a looped condition. A sewing operation, though functional, is quite expensive since the ball retrieving cap 16 and the strap member must be brought into the presence of a sewing machine. Through utilization of the buckle member 88 the cost of the assembly procedure is effectively minimized.

Figure 3:
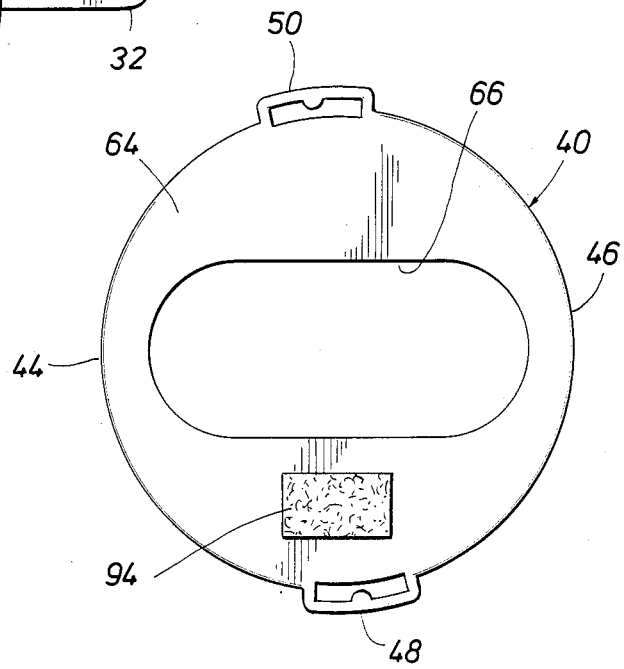
FIG. 3 is an end view taken along line 3—3 of FIG. 1.

As shown in FIGS. 1 and 3, provision is made for securing the dispensing cap in assembly with the tubular member when the dispensing cap is not assemblied to the lower end of the inner tubular member. The dispensing cap 40 is provided with a patch 94 of retaining material, which may take the form sold under the registered trademark VELCRO. The outer tubular member 12 is provided with a similar patch of retaining material 96. When the dispensing cap is not in use, the patches of retaining material 94 and 96 are brought into adhered assembly and thus the dispensing cap is firmly secured to the outer tubular member untill such time as it is again needed. It is then simply pulled away from the outer tubular member and secured at the desired position at the lower end of the inner tubular member.

In view of the foregoing, it respectively submitted that the present invention is one well adapted to attain all of the objects and features hereinabove set forth together with other features which are inherent in the apparatus itself. It will be understood that certain combinations and subcombinations are of utility and may be employed without reference to other featues and subcombinations. This is contemplated by and is within the scope of the present invention.

What is claimed is:

1. A retriever and dispenser for compressible balls such as tennis balls and the like comprising:

(a) an elongated tubular member having an internal substantially straight passage of slightly greater dimension than the diameter of the balls to be contained therein, said tubular member defining first and second extremities, said second extremity forming a dispensing opening in said tubular member oriented in transverse relation to the longitudinal axis of said elongated tubular member;

(b) retrieving means at said first extremity of said tubular member forming a ball retrieving opening through which balls enter said internal passage, said retrieving means forming restriction means at said ball retrieving opening requiring balls to be slightly deformed as the balls are forced past said restriction means and into said internal passage, said restriction means restraining balls from inadvertently falling from said retrieving opening when said tubular member is positioned vertically with said retrieving opening at the lower end thereof;

(c) a dispensing cap being releasably positioned at said second extremity of said tubular member and being reversibly positionable at open and closed positions substantially 180° apart relative to said tubular member, said dispensing cap forming a transverse wall supporting the lower ball when said tubular member is positioned vertically with said dispensing cap forming a transverse wall supporting the lower dispensing cap at the lower end thereof, said dispensing cap further defining a cylindrical wall portion forming a closure for said dispensing opening, said dispensing cap being positionable at said open position permitting dispensing of balls transversely of said substantially straight passage and through said dispensing opening and being positionable at said closed position where said wall portion sufficiently blocks said dispensing opening as to prevent dispensing of balls through said dispensing opening; and (d) means restraining free transverse dispensing movement of said balls from said internal passage through said dispensing opening;

(e) means permitting manual access to the lowermost ball within said internal passage and facilitating manually induced dispensing of said balls past said restraining means and through said dispensing opening.

2. A retriever and dispenser for compressible balls as recited in claim 1, wherein said restraining means comprises:

a ball restraining lip formed on said second extremity of said elongated tubular member being of sufficient height to restrain free transverse movement of said balls and to prevent inadvertent dispensing of said balls when said dispensing cap is at said open position.

3. A retriever and dispenser for compressible balls as recited in claim 1, wherein said restraining means comprises:

a ball restraining lip formed by said elongated tubular member and said dispensing cap.

4. A retriever and dispenser for compressible balls as recited in claim 1, wherein:

said transverse wall of dispensing cap defines a manual access opening through which the fingers of the user are inserted for engagement with the lowermost one of the balls in said internal passage for inducing manual dispensing movement of said lowermost ball past said restraining means and through said dispensing opening.

5. A retriever and dispenser for compressible balls as recited in claim 4, wherein:

said manual access opening is of elongated configuration with the long axis thereof extending toward said dispensing opening.

6. A retriever and dispenser for compressible balls as recited in claim 1, wherein:

said restraining means is a lip defined by said tubular member permitting passage of a ball through said dispensing opening only upon both upward and transverse movement of the lowermost ball in said internal passage.

7. A retriever and dispenser for compressible balls as recited in claim 1, wherein said tubular member comprises:

(a) a pair of tubular sections and having telescoping relation and being relatively movable between extended and collapsed positions; and (b) locking means releasably securing said telescoping tubular sections in suitably positioned immovable telescoping assembly.

8. A retriever and dispenser for compressible balls as recited in claim 7, wherein said locking means comprises:

(a) a locking pin;

(b) a locking opening in the outermost of said tubular sections sized to receive said locking pin;

(c) a plurality of positioning openings in the innermost one of said tubular sections sized to receive said locking pin when one of said positioning openings is aligned with said locking opening in the outermost one of said tubular sections;

(d) a locking band fixed to the outermost one of said tubular sections and securable about said outermost one of said tubular sections;

(e) said locking pin extending from said locking band; and (f) buckle means on said locking band for releasably locking said locking band in tight encircling relation about said outermost one of said tubular sections.

9. A retriever and dispenser for compressible balls as recited in claim 7, wherein:

said retrieving means is provided on one of said telescoping tubular sections and said dispensing cap is provided on the other of said telescoping tubular sections.

10. A retriever and dispenser for compressible balls as recited in claim 1, wherein said tubular member comprises:

(a) first and second tubular sections disposed in telescoping relation; and (b) locking means releasably securing said tubular sections in selected coaxial telescoped relation , and comprising (i) a locking opening in the outermost of said tubular sections sized to receive said locking pin;

(ii) a plurality of positioning openings in the innermost one of said tubular sections sized to receive said locking pin when one of said positioning openings is aligned with said locking opening in the outermost one of said tubular sections;

(iii) a locking band fixed to the outermost one of said tubular sections and is securable about said outermost one of said tubular sections;

(iv) a locking pin extending from said locking band; and (v) buckle means on said locking band for releasably locking said locking band in tight encircling relation about said outermost one of said tubular sections and securing said locking pin within registering locking and positioning openings.

11. A retriever and dispenser for compressible balls as recited in claim 1, wherein:

said retrieving means defines an external hook element positioned for support of said tubular member with said retrieving means at the upper extremity of said tubular member and said dispensing cap at the lower extremity of said tubular member.

12. A retriever and dispenser for compressible balls as recited in claim 1, wherein said retrieving means comprises a generally circular retrieving cap being secured to one end of said tubular member, said retrieving cap defining:

(a) an inlet opening of slightly greater diameter than the diameter of said balls; and (b) a plurality of radially extending internal projections located in substantially equally spaced relation about said inlet opening, said radially extending internal projections cooperating to cause deformation of balls being forced through said inlet opening, said radially extending internal projections operating to support balls within said internal passage to prevent them from falling through said inlet opening.

13. A retriever and dispenser for compressible balls as recited in claim 12 wherein:

said radially extending internal projections form tapered guide surfaces inclined toward said inlet opening, said guide surfaces cooperating to guide said ball through said inlet opening into ball receiving registry with said inlet opening as said tubular member is positioned in retrieving engagement with a ball resting on a playing surface and forced downwardly toward said playing surface.

14. A retriever and dispenser for compressible balls as recited in claim 1, wherein:

said cylindrical wall portion of said dispensing cap forms a first section of sufficient height to form a closure for said dispensing opening at the closed position to said dispensing cap and a second section of diminished height to permit dispensing of said balls through said dispensing opening at the open position of said dispensing cap.

15. A retriever and dispenser for compressible balls as recited in claim 14, wherein:

(a) said tubular member defines a second dispensing opening at said second extremity thereof permitting dispensing of balls in aligned relation with said internal substantially straight passage; and (b) said transverse wall of said dispensing cap forms a closure for said second dispensing opening.

16. A retriever and dispenser for compressible balls as recited in claim 15, wherein:

(a) said dispensing cap is reversibly positionable at said second extremity of said tubular member at open and closed positions substantially 180° apart; and (b) cap locking means secures said dispensing cap in releasable locked assembly with said second extremity of said tubular member at both open and closed positions of said dispensing cap.

17. A retriever and dispenser for compressible balls as recited in Claim 16, wherein said cap locking means comprises;

(a) means defining L-shaped bayonet slot means on said dispensing cap; and (b) retaining pin means being defined by said tubular member and being received by said L-shaped slot means on said dispensing cap.

18. A retriever and dispenser for compressible balls as recited in claim 17, wherein:

said means defining said L-shaped slot means also forms lock restraining means releasably securing said dispensing cap and preventing inadvertent unlocking of said dispensing cap from said tubular member.

19. A retriever and dispenser for compressible ball as as recited in claim 1, wherein:

(a) said elongated tubular member is formed by inner and outer telescoping sections, said outer telescoping section of said elongated tubular member defines spaced strap connectors;

(b) a carrying strap member is provided having end portions thereof looped about said strap connectors; and (c) a pair of buckle fasteners adjustably secure said end portions of said carrying strap to said spaced strap connectors.

20. A retriever and dispenser for compressible balls as recited in claim 19, wherein:

one of said strap connectors is defined by said retrieving means and the other of said strap connectors is located intermediate the extremities of said elongated tubular member.

21. A retriever and dispenser for compressible balls such as tennis balls and the like comprising:

(a) an elongated tubular member having an internal substantially straight passage of slightly greater dimension than the diameter of the balls to be contained therein, said tubular member defining first and second extremities, said second extremity forming a first dispensing opening in the wall of said elongated tubular member adjacent said second extremity and a second dispensing opening formed by said second extremity;

(b) retrieving means at said first extremity of said tubular member forming a ball retrieving opening through which balls enter said internal passage, said retrieving means forming restriction means at said ball retrieving opening requiring balls to be slightly deformed as the balls are forced past said restriction means and into said internal passage, said restriction means restraining balls from inadvertently falling from said retrieving opening when said tubular member is positioned vertically with said retrieving opening at the lower end thereof;

(c) a dispensing cap removably and reversibly positioned at said second extremity of said tubular member and forming a transverse closure wall covering said second dispensing opening and forming wall means, said dispensing cap being positionable at an open position permitting dispensing of balls through said first dispensing opening and being positionable at a closed position where said wall means prevent s dispensing of balls through said first dispensing opening.

(d) retaining pin means being located on said tubular member; and (e) L-shaped bayonet slot means being defined by said wall means and receiving said retaining pin means for locking of said dispensing cap in assembly with said tubular member, said bayonet slot means defining lock restraining means releasably securing said dispensing cap against inadvertent unlocking movement relative to said tubular member.

* * * * *